US006557561B1

(12) United States Patent
Miyauchi et al.

(10) Patent No.: US 6,557,561 B1
(45) Date of Patent: May 6, 2003

(54) CIGARETTE PAPER HAVING A FLAVORANT WHICH IMPROVES SIDESTREAM SMOKE SMELL, AND A CIGARETTE

(75) Inventors: Masato Miyauchi, Yokohama (JP); Toru Sakurai, Tokyo (JP); Hideki Nagae, Yokohama (JP); Hiroshi Tanabe, Yokohama (JP); Hiroaki Nakano, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 2 days.

(21) Appl. No.: 09/666,409

(22) Filed: Sep. 20, 2000

Related U.S. Application Data

(62) Division of application No. 09/177,793, filed on Oct. 23, 1998, now abandoned.

(30) Foreign Application Priority Data

Oct. 24, 1997 (JP) ..... 9-292011

(51) Int. Cl.[7] ..... A24D 1/02; D21H 27/00

(52) U.S. Cl. ..... 131/365; 131/276; 131/274; 162/139

(58) Field of Search ..... 131/274, 277, 131/276, 360, 365, 374; 162/139

(56) References Cited

U.S. PATENT DOCUMENTS

| | | | | |
|---|---|---|---|---|
| 2,886,042 A | | 5/1959 | Hoover | |
| 3,372,701 A | * | 3/1968 | Teague et al. | 131/277 |
| 3,380,457 A | | 4/1968 | Schumacher et al. | |
| 3,563,248 A | * | 2/1971 | Riehl et al. | 131/277 |
| 4,271,853 A | * | 6/1981 | Mookherjee et al. | 131/276 |
| 4,690,157 A | * | 9/1987 | Podraza | 131/276 |
| 4,941,486 A | | 7/1990 | Dube et al. | |
| 5,120,368 A | * | 6/1992 | Houminer et al. | 131/276 |
| 5,144,965 A | * | 9/1992 | Southwick | 131/276 |
| 5,168,884 A | * | 12/1992 | Baldwin et al. | 131/336 |
| 5,172,704 A | * | 12/1992 | Chan et al. | 131/274 |
| 5,479,949 A | * | 1/1996 | Battard et al. | 131/365 |
| 6,194,019 B1 | * | 2/2001 | Anderson | 426/442 |

FOREIGN PATENT DOCUMENTS

| | | |
|---|---|---|
| EP | 0506610 A1 | 9/1992 |
| EP | 0519481 A1 | 12/1992 |
| JP | 4819960 | 6/1973 |
| JP | 49116300 | 11/1974 |
| JP | 5076299 | 6/1975 |
| JP | 5115116 | 5/1976 |
| JP | 5111372 | 5/1993 |

OTHER PUBLICATIONS

Abstract of JP 73019959B; Derwent–Acc–No.: 1973–36074U; Derwent Week: 197325; 1973.

Hajime, Kaneko, *Chemical Abstracts*, vol. 80, No. 11, p. 176, Columbus, Ohio, (Feb. 18, 1974).

Derwent Publications Ltd., London G; AN 1976–45127X, XP002119092 & JP 51 015116 B, (Jun. 18, 1973).

Derwent Publications Ltd., London, GB; An 1977–44422y, XP002119093 & JP 52 057397 A, (May 11, 1977).

* cited by examiner

*Primary Examiner*—Steven P. Griffin
*Assistant Examiner*—Carlos Lopez
(74) *Attorney, Agent, or Firm*—Birch, Stewart, Kolasch & Birch, LLP

(57) ABSTRACT

A cigarette paper having a sidestream smoke smell-improving agent including a lactone in its free state, or a salt of a hydroxy acid corresponding to the lactone, as well as a cigarette wrapped by the cigarette paper. The salt of the hydroxy acid can be an alkali metal salt or an alkaline earth metal salt. The lactone can be a lactone having five or more ring members. The lactone can be a γ-lactone or a δ-lactone.

11 Claims, 3 Drawing Sheets

CIGARETTE PAPER HAVING A FLAVORANT WHICH IMPROVES SIDESTREAM SMOKE SMELL, AND A CIGARETTE

This application is a divisional of co-pending application Ser. No. 09/177,793, filed on Oct. 23, 1998 now abandoned; the entire contents of which are hereby incorporated by reference.

BACKGROUND OF THE INVENTION

The present invention relates to cigarette paper having a flavorant which improves the sidestream smoke smell, and a cigarette.

Many kinds of flavorant or aroma substances are added to tobacco articles, such as cigarettes, to improve the flavor and taste of the tobacco smoke. In recent years, to improve the smell of the sidestream smoke released to the ambient or during smoking, it has been proposed to add, to cigarette paper, a flavorant which masks the unpleasant smell. However, almost all of the flavorants used in tobacco articles, such as those added to cigarette paper, are highly volatile at ordinary temperature, and are volatilized by vaporization or sublimation. Therefore, the flavor released from the flavorant in the process of producing the tobacco article is incorporated into the sites where the tobacco article is produced, so as to affect the properties of the tobacco article, such as the flavor and the taste, or to cause deterioration with time in the quality of the tobacco article during preservation. The flavorant added to the cigarette paper is transferred to the cut tobacco or the packaging material for the tobacco article to affect the tobacco flavor and taste.

Thus, flavorants or flavorant-releasing agents are proposed which are modified to suppress the volatilization of the flavorant during non-smoking, be stable and nonvolatile in the production and preservation of tobacco articles and release the flavor by thermal decomposition or desorption during smoking. For example, Jpn. Pat. Domestic Announcement No. 2-501075 or U.S. Pat. No. 4,804,002 disclose a flavorant composed of a glycoside of an aroma substance. Jpn. Pat. Appln. KOKAI Publication No. 5-146285 or U.S. Pat. No. 5,144,964, and Jpn. Pat. Domestic Announcement No. 7-504080 or U.S. Pat. No. 5,479,949 disclose the techniques of including a flavoring material within cyclodextrin.

However, in the prior art mentioned above, there is a possibility that the carbohydrate glycoside or cyclodextrin, which is added to suppress the volatilization of the aroma substance or the flavoring material during non-smoking, produces a thermally decomposed product during smoking, and this product is incorporated into the tobacco smoke to deteriorate the tobacco flavor and taste. Also, it may increase the cost for production of the tobacco article.

BRIEF SUMMARY OF THE INVENTION

Therefore, an object of the present invention is to provide a cigarette paper having a sidestream smoke smell-improving agent that does not substantially release any odor during non-smoking but can mask an unpleasant smell of the sidestream smoke during smoking so as to improve the smell of the sidestream smoke, though having a relatively simple structure, as well as a cigarette.

In order to accomplish this object, the present inventors have made many investigations on sidestream smell-improving agents which are to be carried on a cigarette paper. As a result, they have found that a lactone releases a sufficient amount of flavor during smoking even if used in a small amount, and in hardly releases any flavor and maintains its state of being stably carried by the cigarette paper even if it is in its free state.

On the basis of the aforementioned finding (the first finding), the present invention provides a cigarette paper which has a sidestream smoke smell-improving agent comprising a lactone in its free state.

In the present invention, the lactone preferably has a 5 or more ring members. Such a preferred lactone can be selected from the group consisting of γ-butyrolactone, γ-valerolactone, γ-heptalactone, γ-hexalactone, γ-octalactone, γ-nonalactone, γ-decalactone, γ-undecalactone, sautalone, abhexone, δ-octalactone, δ-nonalactone, δ-decalactone, δ-undecalactone, ω-pentadecalactone, and mixtures thereof. The lactone is especially preferably a γ-lactone or a δ-lactone.

In the present invention, the lactone may be applied to the cigarette paper as a solution in an aqueous solvent and may be in a dried state.

On the basis of the first finding, the present invention also provides a cigarette wrapped by a cigarette paper, the cigarette paper having a sidestream smoke smell-improving agent comprising the lactone.

In this case, the cigarette paper may be adhered by an aqueous adhesive, and the lactone may be carried by the cigarette paper by incorporating the lactone in the adhesive.

Incidentally, the inventors have further made investigations on the lactone noted above to find that a hydroxy acid salt, which can be obtained by adding a base to an aqueous solution of the lactone to open the lactone ring, is odorless without flavor by itself, and that in burning cigarette paper (in smoking) the salt is ring-closed to produce a corresponding lactone, thereby releasing the same flavor as in case of the corresponding lactone in its free state (second finding).

On the basis of the second finding, the present invention provides a cigarette paper having a sidestream smoke smell-improving agent comprising a salt of a hydroxy acid corresponding to a lactone.

In the present invention, the salt of the hydroxy acid is preferably an alkali metal salt or an alkaline earth metal salt.

Further, it is preferred that the salt of the hydroxy acid is a salt of a hydroxy acid corresponding to a lactone having a 5 or more ring members. Such a preferred salt of the hydroxy acid is a salt of hydroxy acid corresponding to a lactone selected from the group consisting of γ-butyrolactone, γ-valerolactone, γ-heptalactone, γ-hexalactone, γ-octalactone, γ-nonalactone, γ-decalactone, γ-undecalactone, sautalone, abhexone, δ-octalactone, δ-nonalactone, δ-decalactone, δ-undecalactone, ω-pentadecalactone, and mixtures thereof. The salt of the hydroxy acid is especially preferably a salt of a hydroxy acid corresponding to a γ-lactone or a δ-lactone.

In the present invention, the salt of the hydroxy acid may be applied to the cigarette paper as a solution in an aqueous solvent and may be dried.

Furthermore, on the basis of the second finding, the present invention provides a cigarette wrapped by a cigarette paper, the cigarette paper having a sidestream smoke smell-improving agent comprising a salt of a hydroxy acid corresponding to a lactone.

In this case, the cigarette paper may be adhered by an aqueous adhesive, and the salt of a hydroxy acid may be carried by the cigarette paper by incorporating the salt in the adhesive.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
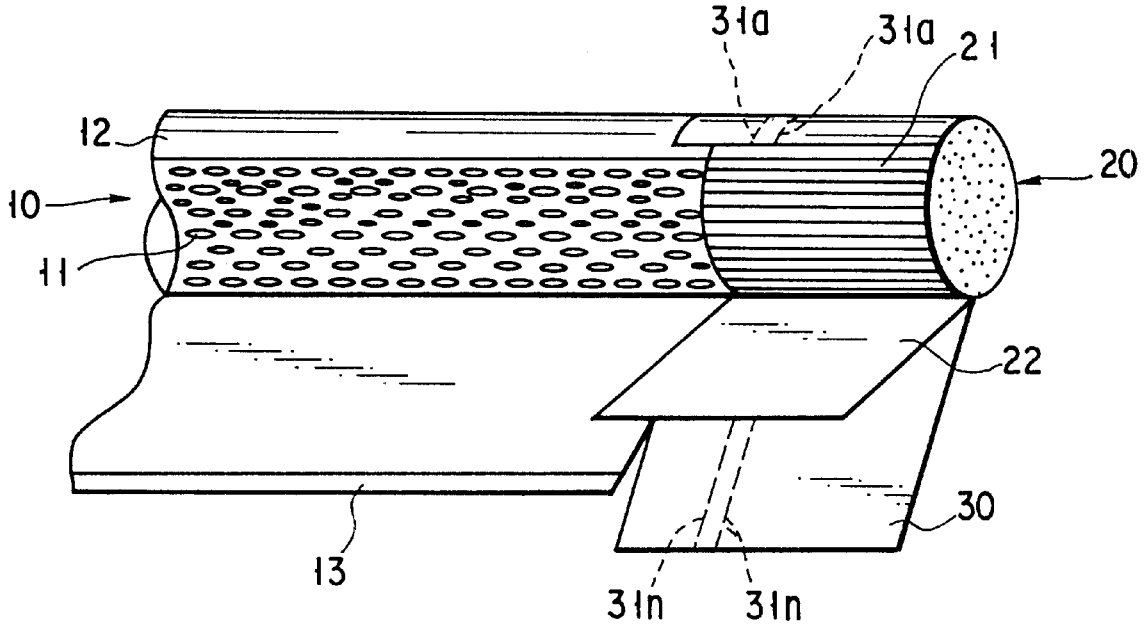
FIG. 1 is a partially exploded, perspective view showing a part of a cigarette of the present invention.

The present invention will be described in detail below.

The lactone used in the present invention is a flavorant which can be dissolved in water, though slightly, and releases a strong flavor or aroma. It has been found that even if the lactone is carried in such an amount that an aqueous solution of the lactone is applied to cigarette paper and is dried, the lactone releases a sufficiently strong flavor or aroma during smoking, and the flavor or aroma is hardly released therefrom during non-smoking (i.e., the lactone is substantially odorless).

The lactone used in the present invention is not particularly limited, but preferably has a 5 or more ring members. Examples of such a preferred lactone include γ-butyrolactone (flavor: faint sweet aroma), γ-valerolactone (flavor: mildly sweet hay and tobacco-like herb aroma), γ-heptalactone (flavor: coconut-like fruit aroma, slight caramel aroma), γ-hexalactone (flavor: a strong herb aroma and sweet tobacco-like aroma), γ-octalactone, γ-nonalactone (flavor: coconut-like fruit aroma), γ-decalactone (flavor: peach-like fruit aroma), γ-undecalactone (flavor: peach-like fruit aroma), sautalone or 4,5-dimethyl-3-hydroxyγ-2(5H)-furanone (flavor: curry-like spicy aroma), abhexone or 4-methyl-5-ethyl-3-hydroxy-2(5H)-furanone, δ-octalactone, δ-nonalactone (flavor: coconut-like fruit aroma), δ-decalactone (flavor: coconut-like fruit aroma), δ-undecalactone (flavor: peach-like fruit aroma), ω-pentadecalactone (flavor: sweet musk aroma), and mixtures thereof. The lactone used in the present invention is especially preferably a γ-lactone or a δ-lactone.

The sidestream smoke smell-improving agent in the present invention includes the above-mentioned lactone in its free state. The free state referred to herein means that lactone molecules exist as they are in the cigarette paper, or exist in a state that they are held in the cigarette paper by physical adsorption or chemical effect between the molecules and cigarette paper-constituting components, such as cellulose components or calcium carbonate. Therefore, the lactone in the present invention is different from a lactone added in cigarette paper in a state that it is chemically bonded with other components (for example, in the form of its glycoside) in advance or that it is physically jointed with other components (for example, in the form of a cluster) in advance. The sidestream smoke smell-improving agent in the present invention preferably consists essentially of the aforementioned lactone.

The sidestream smoke smell-improving agent comprising the lactone used in the present invention can be conveniently contained into a cigarette paper by applying the agent, as a solution in an aqueous solvent, to the cigarette paper and drying it. The aqueous solvent which can be used may be water or organic solvents (in particular, ethanol) containing water. An especially preferred aqueous solvent is water.

In that case, a lactone is dissolved in the aforementioned aqueous solvent to prepare a lactone solution and then the lactone solution is applied to a cigarette paper. For applying the lactone solution to a cigarette paper, use may be made of a method of dipping the cigarette paper into the lactone solution, a method of coating it by using a roll coater or a gravure printing press. Alternatively, the lactone solution can be applied to a cigarette paper in a size press section in the process of making the cigarette paper. In these cases, the lactone solution may be applied to the cigarette paper entirely or partially. The lactone may be added to a raw material of the paper in the process of making cigarette paper. In this way, a desired cigarette paper which has the lactone in its free state can be produced.

The cigarette paper, which can be used in the present invention, may be any paper used for a cigarette, such as ordinary cigarette paper, tobacco powder-containing cigarette paper, and low sidestream smoke cigarette paper. The low sidestream smoke cigarette paper generates a small amount of sidestream smoke but gives an unpreferable odor; therefore, the present invention is particularly applied to this paper. Especially preferable low sidestream smoke cigarette paper is cigarette paper which has an air permeability of 25 CORESTA units or less, and a basis weight of 15–80 g/m$^2$, and contains a compound exhibiting effect of reducing sidestream smoke. The compound exhibiting the effect of reducing sidestream smoke is a compound selected from oxides or hydroxides of alkali or alkaline earth metals and alkali or alkaline earth metal salts of organic or inorganic acids; or calcium carbonate which is added in such that its outer surface area per square meter of cigarette paper will become 80 square meters or more.

In the present invention, the amount of the lactone applied to the cigarette paper is preferably from 0.1 to 1000 mg and more preferably from 0.5 to 100 mg, per square meter of the cigarette paper.

The lactone flavorant applied to the cigarette paper as described above is held very stably by the cigarette paper at ordinary temperature, substantially not releasing flavor nor presenting the transferring the flavor during storage. Furthermore, during smoking, as the paper burns, the lactone applied to the cigarette paper selectively releases the flavor into the sidestream smoke to mask unpleasant odor of the sidestream smoke. Thus, smell of the sidestream smoke is effectively improved.

In the present invention, instead of the lactone in its free state, a salt of hydroxy acid (a hydroxy acid salt) which is produced by adding a base into the aforementioned lactone solution to open the lactone ring can be applied to the cigarette paper. Since the cigarette paper having such a hydroxy acid salt is low in volatilizability and odorless, the transferring of the flavor during the production or storage of cigarettes can be more reduced than the case where the lactone in its free state is used. During smoking (i.e., while the cigarette paper is burning), the hydroxy acid salt corresponding to a lactone, applied to the cigarette paper, is ring-closed to yield the lactone, thus releasing a sufficient amount of flavor, as in the case where the free lactone is used. Therefore, an unpleasant smell of the sidestream smoke is masked to improve the sidestream smoke smell effectively. The formations of a lactone and the hydroxy acid salt corresponding to the lactone is based on an equilibrium reaction.

The hydroxy acid salt corresponding to a lactone can be applied to the cigarette paper as follows. An aqueous solution containing the lactone, together with a suitable base, dissolved therein is applied to the cigarette paper in the same manner as in the case of the lactone in its free state. Alternatively, the lactone and a base can be added to a raw material of a paper and then the cigarette paper can be made from the raw material. The hydroxy acid salt corresponding to a lactone, which is obtained by adding a base to the aqueous solution of the lactone, has a high solubility in water; therefore, the concentration thereof in the aqueous solution can be increased as compared with that of the lactone in its free state, and a larger amount thereof can be contained into the cigarette paper.

The lactone produced by ring-closing the hydroxy acid salt upon burning is the same as the lactone in its free state. Thus, the hydroxy acid salt is preferably a salt of a hydroxy acid corresponding to a lactone having a 5 or more lactone-ring members. Preferred examples thereof include salts of hydroxy acids corresponding to γ-butyrolactone, γ-valerolactone, γ-heptalactone, γ-hexalactone, γ-octalactone, γ-nonalactone, γ-decalactone, γ-undecalactone, sautalone, abhexone, δ-octalactone, δ-nonalactone, δ-decalactone, δ-undecalactone, ω-pentadecalactone, and mixtures thereof. The hydroxy acid salt is especially preferably a salt of a hydroxy acid corresponding to a γ-lactone or a δ-lactone.

The base used to ring-open the lactone to produce a corresponding hydroxy acid salt is not particularly limited. Preferably, carbonates, hydrogencarbonates and hydroxides of alkali metals or alkaline earth metals, or mixtures thereof can be used. Thus, preferred hydroxy acid salts are alkali metal salts or alkaline earth metal salts. Considering the time during which the hydroxy acid salt is produced at ordinary temperature (i.e., 25° C.), it is desired that the pH of the basic solution is 10 or more. However, even if the pH is 8 or more, the production of the hydroxy acid salt advances and the time necessary for the production of the hydroxy acid salt is shortened at higher temperature.

If the base concentration of the basic aqueous solution containing the hydroxy acid salt corresponding to a lactone is too high, there may be possibility that when the aqueous solution is applied to the cigarette paper, the cigarette paper may turn yellow. To avoid this, the base concentration is desirably in such an extent that the paper does not turn yellow. For example, in case of sodium hydroxide, the base concentration, i.e., the concentration of sodium hydroxide, is 1% by weight or less, and in case of sodium carbonate, the base concentration is 4% by weight or less. When the concentration of the lactone is increased under a basic condition, bubbles may be generated (saponification); therefore, there is a possibility that the lactone cannot be held stably on the cigarette paper. In order not to generate such bubbles, it is desirable that the lactone concentration is 5% by weight or less in the case of a 1% sodium hydroxide concentration condition.

In the present invention, the amount of the hydroxy acid salt contained into the cigarette paper, which is converted into a weight of the corresponding lactone, is preferably from 0.1 to 10000 mg and more preferably from 0.5 to 100 mg per square meter of the cigarette paper.

A cigarette of the present invention can be manufactured in a conventional manner by using the cigarette paper of the invention containing the lactone in its free state or the hydroxy acid salt, prepared in advance. The cigarette is wrapped in such cigarette paper having the sidestream smoke smell-improving agent of the invention and then the cigarette paper is adhered at its overlapped edge end portions with a so-called seam paste comprising an aqueous adhesive (for example, a carboxymethylcellulose-based adhesive or a vinyl acetate-based aqueous adhesive). Alternatively, a cigarette can be wrapped in a cigarette paper not having the sidestream smoke smell-improving agent of the invention, and the cigarette paper can be adhered at its overlapped edge end portions by using a seam paste containing the sidestream smoke smell-improving agent of the invention beforehand. Of course, the cigarette of the present invention may have a filter attached thereto. Namely, the cigarette of the present invention may have the same structure as ordinary cigarettes except that the cigarette paper of the present invention is used.

FIG. 1 is a partially exploded, perspective view partially showing a cigarette of the present invention. The cigarette shown in FIG. 1 has a cigarette portion 10 composed of a tobacco column 11 which is generally in a cylindrical form, wrapped by a cigarette paper 12 which carries the sidestream smoke smell-improving agent of the invention (not shown). The tobacco column 11 may comprise a cut tobacco. The cigarette paper 12 is adhered at its overlapped edge end portions with a seam paste 13 as noted above. To one end of the cigarette portion 10, a filter portion 20 is fitted. The filter portion 20 is composed of a filter element 21 comprising, e.g., a tow of cellulose acetate fibers, wrapped by a thin filter wrapper 22. The cigarette portion 10 and the filter portion 20 are connected together by being wrapped by a so-called tip paper 30. In the tip paper 30, a plurality of ventilation holes 31*a*–31*n* may be made in a row or rows along the circumferential direction of the cigarette. In FIG. 1, such ventilation holes are made in a form of two rows.

When the cigarette of the present invention is smoked, an unpleasant smell of the sidestream smoke is masked by the flavor released from the sidestream smoke smell-improving agent of the invention. The flavor released from the sidestream smoke smell-improving agent during smoking is not substantially released into the main stream smoke but substantially selectively released into only the sidestream smoke, so that the flavor and the taste of the cigarette is not affected substantially.

As described above, the sidestream smoke smell-improving agent of the invention comprising a lactone in its free state or a hydroxy acid salt may be applied as a solution in an aqueous solvent, in particular, water, to the cigarette paper. Therefore, the present invention is advantageous from the viewpoint of operation efficiency or safety.

The present invention will be further described below by way of Examples.

EXAMPLE 1

<Preparation of Cigarette Paper Having a Lactone>

An aqueous solution of γ-undecalactone (γ-undecalactone concentration: 7.5–100 mg/L) was applied to a commercially available, low sidestream smoke cigarette paper. This cigarette paper was heated in a vacuum at 300° C. for 1 hour. The generated vapor of γ-undecalactone was trapped by liquid nitrogen and the amount thereof was measured by gas chromatography. The method wherein a cigarette paper is heated and decomposed, and the amount of the lactone is determined will be hereinafter referred to as a "thermal decomposition method".

Table 1 below shows the concentration of γ-undecalactone in the aqueous solution (mg/L), and the amount (initial amount) of γ-undecalactone contained per square meter of the cigarette paper (mg/m$^2$).

<Change with Time of the Amount of a Lactone Remaining>

Next, the following acceleration test was carried out as a preservation test to examine change with time of the amount of the γ-undecalactone remaining in the cigarette paper.

Specifically, the aforementioned respective cigarette paper samples containing the lactone were put into an adsorption container having a gas inlet port and a gas outlet port, and then nitrogen gas at a temperature of 30° C. and a relative humidity of 60% was supplied from the gas inlet port into the container until the nitrogen gas and the cigarette paper samples would reach a equilibrium state (a stable state) (over 48 hours). The amount of the γ-undecalactone in the cigarette paper samples reaching the equilibrium state was determined by the thermal decomposition method. Results obtained are also shown in Table 1 as "Equilibrium Amount Remaining After the Acceleration Test".

TABLE 1

| Aqueous Solution γ-Undecalactone Concentration (mg/L) | Amount of γ-Undecalactone in Cigarette Paper: Initial Amount (mg/m$^2$) | Amount of γ-Undecalactone in Cigarette Paper: Equilibrium Amount Remaining After the Acceleration Test (mg/m$^2$) |
|---|---|---|
| 7.5 | 0.4 | 0.4 |
| 30 | 0.9 | 0.9 |
| 60 | 1.4 | 1.3 |
| 100 | 1.6 | 1.3 |

As can be seen from the results shown in Table 1, γ-undecalactone remained in the cigarette paper, and the amount of the remaining lactone after the acceleration test was substantially the same as the initial amount thereof. Therefore, it was found that the amount of γ-undecalactone remaining in the cigarette paper was maintained substantially constant during the preservation at room temperature.

The respective lactone-containing cigarette paper samples were dried in vacuum at a temperature of 30° C. and a pressure of $10^{-2}$ Pa or less for 2 days, with the result that the amount of γ-undecalactone was hardly changed.

EXAMPLE 2

An aqueous solution of γ-undecalactone (concentration of γ-undecalactone: 90 mg/L) was applied to a commercially available low sidestream smoke cigarette paper at a size press section (width: 2.5 m×length: 2700 m) in a paper-making process. The amount of the lactone remaining in the cigarette paper was measured using a detector GC-MS (SIM) by the thermal decomposition method (condition: 300° C. for 1 minute). As a result, the average value of the amount of remaining γ-undecalactone was 1.5 mg/m$^2$, with the standard deviation of 0.17 mg/m$^2$. Therefore, it was found that γ-undecalactone was substantially uniformly maintained.

EXAMPLE 3

The respective lactone-containing cigarette paper samples obtained in Example 1 were used to prepare cigarettes in a conventional manner. The respective cigarettes were preserved at a temperature of 22° C. and a relative humidity of 60% for 40 days or 100 days. Subsequently, the pieces of the cigarette paper were taken away from the respective cigarettes, and then the amount of remaining γ-undecalactone was determined by the thermal decomposition method (a temperature of 300° C. for 1 hour). Results obtained are shown in Table 2.

TABLE 2

| Amount of γ-Undecalactone in Cigarette Paper: Initial Amount (mg/m$^2$) | After 40-Day Preservation (mg/m$^2$) | After 100-Day Preservation (mg/m$^2$) |
|---|---|---|
| 0.4 | 0.3 | 0.3 |
| 0.9 | 1.0 | 0.7 |
| 1.4 | 1.1 | 1.2 |
| 1.6 | 1.4 | 1.4 |

As can be seen from the results shown in Table 2, the amount of γ-undecalactone in the cigarette paper was kept substantially constant.

On the respective cigarettes, the delivery amount of γ-undecalactone into the main stream smoke was measured. The smoking condition was according to the conditions specified in ISO 3308 (35 mL, suction for 2 seconds per minute). 20 pieces were smoked for each of the cigarettes. The amount of γ-undecalactone was measured in tar trapped in a Cambridge filter. As a result, with all of the cigarettes, the amount of the lactone in the main stream smoke was below the detection limit by the detector GC-MS (mass spectrum), that is, 100 pg or less per cigarette.

This result also demonstrated that according to the cigarettes of the present invention, γ-undecalactone was hardly transferred to the main stream smoke.

EXAMPLE 4

Using three lactones shown in Table 3 below, lactone-containing cigarette paper samples were prepared. For each of the samples, the initial amount of the lactone and the equilibrium amount of the lactone remaining after the acceleration test were measured in the same manner as in Example 1. Results thus obtained are also shown in Table 3.

TABLE 3

| Lactone | Lactone Concentration in Aqueous Solution (mg/L) | Amount of γ-Undecalactone in Cigarette Paper: Initial Amount (mg/m$^2$) | Amount of γ-Undecalactone in Cigarette Paper: Equilibrium Amount Remaining After the Acceleration Test (mg/m$^2$) |
|---|---|---|---|
| δ-Decalactone | 400 | 12.5 | 10.8 |
| γ-Nonalactone | 800 | 13.5 | 11.4 |
| Sautalone | 800 | 22.4 | 18.0 |

From the results shown in Table 3, it is apparent that the remaining amount of, even a lactones other than γ-undecalactone, 80% or more of the initial amount was stably maintained after the acceleration test.

EXAMPLE 5

<Confirmation of Formation of a Hydroxy Acid Salt corresponding to a Lactone>

Figure 2:
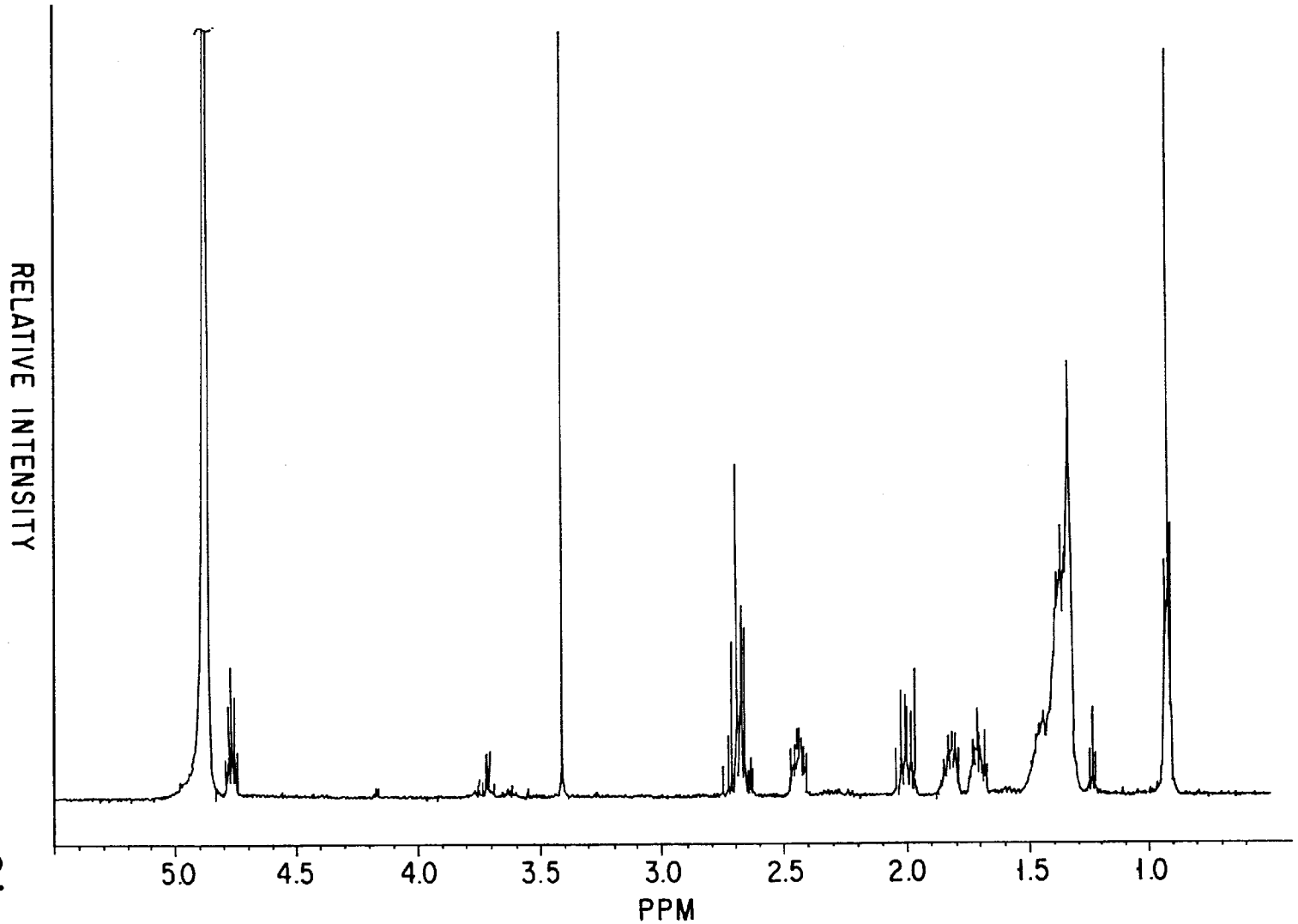
FIG. 2 is a proton NMR spectrum of γ-undecalactone.
Figure 3:
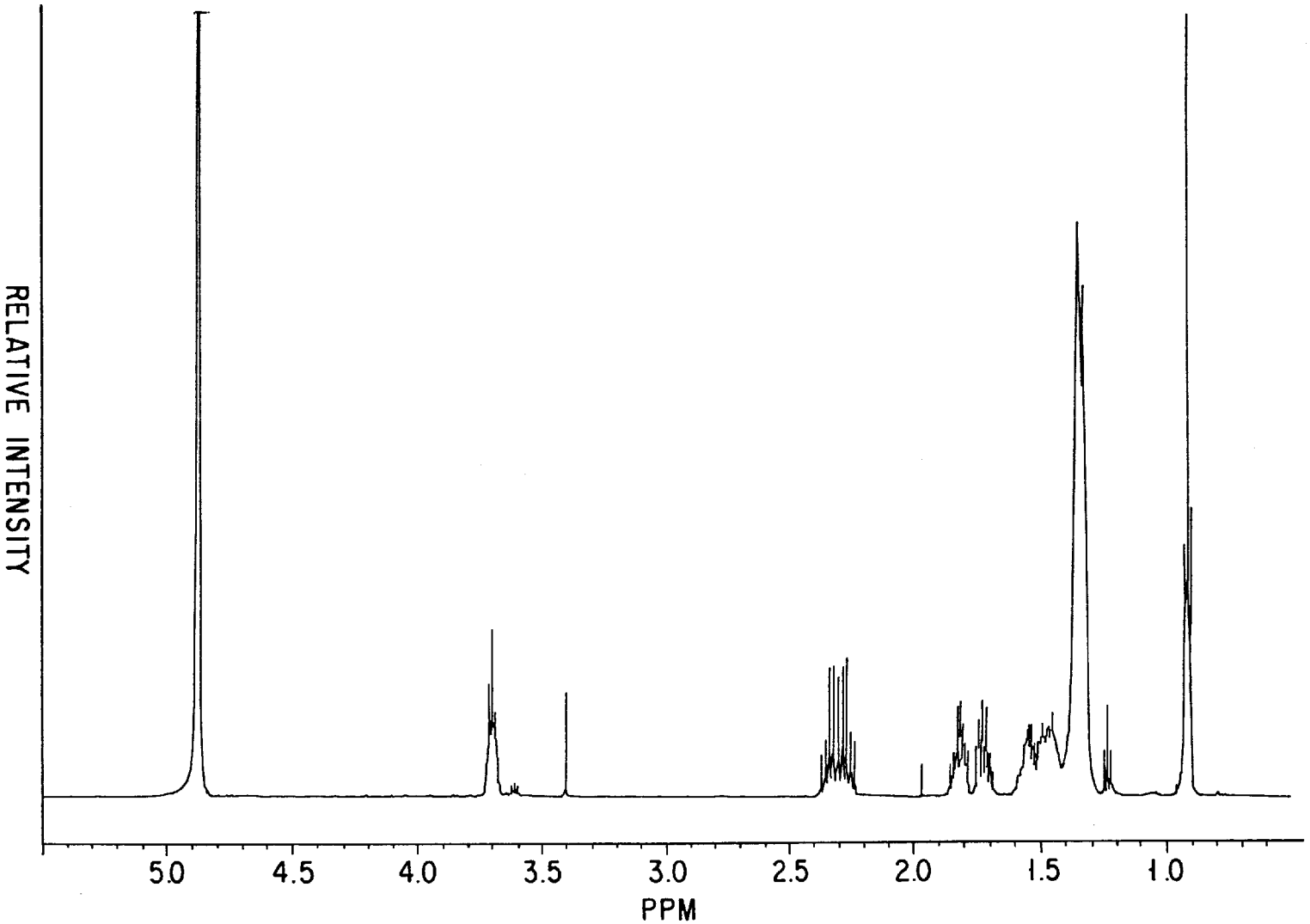
FIG. 3 is a proton NMR spectrum of a hydroxy acid salt obtained by treating γ-undecalactone with a base.

To confirm that a hydroxy acid salt is produced from a lactone in the present of a base, a proton NMR spectrum of an aqueous solution of γ-undecalactone (γ-undecalactone concentration: 200 mg/L) and that of an aqueous solution containing 0.1% by weight of potassium hydroxide and 800 mg/L of γ-undecalactone were obtained. FIG. 2 shows the spectrum of the aqueous solution of γ-undecalactone, and FIG. 3 shows the spectrum of the aqueous solution of γ-undecalactone in the presence of potassium hydroxide. From FIGS. 2 and 3, it was confirmed that the lactone was ring-opened in the presence of potassium hydroxide, to produce the corresponding hydroxy acid salt. <Formation Rate of a Hydroxy Acid Salt in the Presence of Various Bases>

γ-Undecalactone was added to a 0.1% by weight aqueous solution of sodium hydroxide, potassium hydroxide, magnesium hydroxide, sodium carbonate (monohydrate), potassium carbonate (1.5 hydrate), calcium carbonate or sodium hydrogencarbonate, so that the concentration of γ-undecalactone would be 100 mg/L, and then was continuously stirred at room temperature (25° C.) for 9 hours. At this time, the rate-of γ-undecalactone remaining in the aqueous solution after stirring for 5 hours and the rate of γ-undecalactone remaining in the aqueous solution after stirring for 9 hours were measured, to obtain the rate of a hydroxy acid salt formed. Results are shown in Table 4.

TABLE 4

| Aqueous Solution | Formation Rate of Hydroxy Acid (%) After 1.5 Hours | After 9.0 Hours | pH of Aqueous Solution |
|---|---|---|---|
| 0.1% NaOH | 100 | 100 | 12.4 |
| 0.1% KOH | 100 | 100 | 12.2 |
| 0.1% $Na_2CO_3 . H_2O$ | 86 | 91 | 11.0 |
| 0.1% $K_2CO_3 . 1.5H_2O$ | 83 | 88 | 11.0 |
| 0.1% $Mg(OH)_2$ | 49 | 91 | 10.4 |
| 0.1% $CaCO_3$ | 3 | 26 | 9.71 |
| 0.1% $NaHCO_3$ | 8 | 9 | 8.65 |

From these results, it was found that the formation of the hydroxy acid salt corresponding to the lactone proceeded in all of the basic solutions, and the rate of producing the hydroxy acid salt was larger in cases wherein the strong base was added than in cases wherein the weak base was added.

Furthermore, on the aqueous solution of magnesium hydroxide, whose rate of producing the hydroxy acid salt was relatively small, an experiment as to the formation of the hydroxy acid salt at higher temperature was conducted. Specifically, this aqueous solution was stirred at a temperature of 80° C., and the rate of producing the hydroxy acid salt was obtained. As a result, the rate of 0.04 mM/minute was achieved, which corresponds to about ten times as large as the rate of producing the hydroxy acid salt at a temperature of 25° C.

From the aforementioned results, it was confirmed that considering the time necessary for the formation of the hydroxy acid salt at ordinary temperature, the pH of the basic solution is desirably 10 or more but the formation proceeds even at a pH of 8 or more, and that the time necessary for the formation of the hydroxy acid salt can be shortened at higher temperatures.

<Confirmation of the Formation of a Lactone from the Hydroxy Acid Salt>

The aqueous solutions in which the hydroxy acid salts had been formed was subjected to heating treatment at a temperature of 300° C. for 1 minute. For each of the aqueous solutions thus treated, the formation of γ-undecalactone was examined by the thermal decomposition GC-MS. As a result, the formation of γ-undecalactone was confirmed in all of the aqueous solutions.

<Preparation of Cigarette Paper Having a Hydroxy Acid Salt>

γ-Undecalactone and a base were dissolved in water at concentrations shown in Table 5, to obtain an odorless aqueous solution. This aqueous solution was applied to a commercially available low sidestream smoke cigarette paper, and then dried at 100° C. for 2 hours. From the obtained hydroxy acid salt-containing cigarette papers, the flavor peculiar to γ-undecalactone was not confirmed. The amount of the hydroxy acid salt in each of the hydroxy acid salt-containing cigarette papers was determined as the amount of remaining γ-undecalactone by the thermal decomposition method. Results obtained are also shown in Table 5.

γ-Undecalactone was dissolved in 80% by weight aqueous solution of ethanol, and then this solution was applied to the cigarette paper and dried in the same manner to obtain γ-undecalactone-containing cigarette paper. The amount of remaining γ-undecalactone was determined by the thermal decomposition method. Results thereof are shown in Table 5.

TABLE 5

| Aqueous Solution Kind | γ-Undecalactone Concentration (mg/L) | Amount of Remaining γ-Undecalactone ($mg/m^2$) |
|---|---|---|
| 80% Ethanol | 100 | 3.5 |
| 0.1% KOH | 100 | 4.0 |
| 1% KOH | 100 | 4.5 |

As can be seen from the results shown in Table 5, the amount of contained γ-undecalactone in the cigarette paper coated with the aqueous solution in which the lactone had been converted into the hydroxy acid salt by adding potassium hydroxide was substantially the same as the case where γ-undecalactone was directly added. Therefore, it was confirmed that, using the lactone-basic solution, the lactone could be added, in a form beforehand converted into the hydroxy acid salt, to a cigarette paper or raw materials used in the production of a cigarette.

EXAMPLE 6

γ-Undecalactone was added to a 0.1% by weight aqueous solution of sodium hydroxide, potassium carbonate (1.5 hydrate), sodium carbonate, magnesium hydroxide, or potassium hydroxide, and then stirred at room temperature (25° C.) for 23 hours. Subsequently, a low sidestream smoke cigarette paper was immersed into each of the obtained solutions, and then dried at 100° C. for 2 hours to prepare desired cigarette papers, respectively. The concentration of γ-undecalactone was 500 mg/L, which was 5 times as high as that in Example 4. As a control, a 30% by weight aqueous ethanol solution containing γ-undecalactone was applied to the cigarette paper and then dried in the same manner as above to prepare a lactone-containing cigarette paper. Using the GC-MS (SIM), the amount of the remaining γ-undecalactone in these cigarette papers was measured by the thermal decomposition method (thermal decomposition condition: 300° C. for 0.1 minute). Results thus obtained are shown in Table 6.

TABLE 6

| Base | Amount of Remaining γ-Undecalactone |
|---|---|
| NaOH | 26.5 |
| $K_2CO_3 . 1.5H_2O$ | 30.7 |
| $Na_2CO_3$ | 25.3 |
| $Mg(OH)_2$ | 24.8 |
| $Ca(OH)_2$ | 32.0 |
| Control | 4.1 |

As can be seen from Table 6, also in cases where various bases were used, γ-undecalactone was formed in the obtained cigarette paper. The amount of the remaining undecalactone in these cases was 6–7 times as large as that of the control. Thus by using the basic solution, effectively carrying the lactone in the cigarette paper and producing the lactone by thermal decomposition were confirmed.

EXAMPLE 7

In this Example, an ordinary cigarette paper containing calcium carbonate and an organic acid salt, three commercially available low sidestream smoke cigarette papers, and a cigarette paper containing a tobacco powder were used. A 0.1% by weight aqueous sodium hydroxide solution containing 250, 500 or 1000 mg/L of γ-undecalactone was stirred until the flavor of γ-undecalactone became extinct. The aforementioned cigarette paper samples were immersed into the respective solutions, and were dried at a temperature of 100° C. for 2 hours. The amount of remaining γ-undecalactone in the obtained cigarette paper samples was measured by the thermal decomposition method, with the result that the amount of γ-undecalactone remaining in the respective cigarette paper samples was substantially constant regardless of components constituting the cigarette paper samples. The amount of remaining lactone was in proportion to the concentration of γ-undecalactone in the solution, and the remaining amount in the respective cigarette paper samples wherein the lactone was applied by using the 1000 mg/L solution was about 13.4 to 41.2 mg/m$^2$. Thus, it was found that the present technique could be applied to various cigarette papers.

EXAMPLE 8

The following experiment was carried out to examine how much a lactone was contained in cigarette paper.

Specifically, to 1% by weight aqueous sodium hydroxide solution, 5% (v/v) of γ-undecalactone was added, and then allowed to stand in a hot water bath of 80° C. for 4 hours. Subsequently, a cigarette paper was immersed into this solution and dried. The amount of remaining γ-undecalactone in the obtained cigarette paper was measured by the thermal decomposition method. It was 1800 mg/m$^2$.

EXAMPLE 9

The effect of improving the smell of the sidestream smoke by a lactone contained in cigarette paper was evaluated by a organoleptic evaluation test. The evaluation was based on a one-pair comparing method of smelling the sidestream smoke generated from a cigarette sample wrapped in a cigarette paper containing no lactones (a control sample) and that generated from a cigarette sample wrapped in cigarette papers containing a lactone or a corresponding hydroxy acid salt. The evaluation was carried out according to the Sheffe method, in which the degree of difference between the samples was recorded on an evaluation index table. To eliminate order-effect dependent on the order of smelling the samples, repeated evaluations wherein the order of smelling the samples was contrary were carried out for the respective pairs. The improving effect was determined by judging whether or not the degree-difference between the samples which was obtained for respective evaluating items was statistically significant.

The sidestream smoke, which was an odor sample whose odor was smelled, was generated by using 2 adjacent sidestream smoke-generating machines. The concentration of smoke at a smoking portion was a value under a heavy condition, that is, about 2 smoke streams/m$^3$, assuming the condition-that the smoke trailed to a nose. Panels for evaluating the smell were 10–15 men and women who were twenties or thirties and had a good sense of smell selected by an olfactometer method. The specification of all the cigarette samples was the same except for the cigarette paper.

Table 7 shows cigarette samples for evaluation, and Table 8 shows evaluation results.

TABLE 7

| Sample No. | Lactone | Application Method | Cigarette Paper | Contained Amount of Lactone (mg/m$^2$) |
|---|---|---|---|---|
| 1 | γ-Undecalactone | Aqueous Solution Applied | Low Sidestream Smoke Paper | 1.3 |
| 2 | γ-Undecalactone | Aqueous Solution Applied | Low Sidestream Smoke Paper | 4.1 |
| 3 | γ-Undecalactone | Base Solution Applied | Usual Paper | 10.1 |
| 4 | γ-Nonalactone | Aqueous Solution Applied | Low Sidestream Smoke Paper | 13.5 |
| 5 | δ-Decalactone | Aqueous Solution Applied | Low Sidestream Smoke Paper | 12.5 |
| 6 | Sautalone | Aqueous Solution Applied | Low Sidestream Smoke Paper | 22.4 |

TABLE 8

| Evaluated Item | Sample No. 1 | 2 | 3 | 4 | 5 | 6 |
|---|---|---|---|---|---|---|
| Reduction of Unpleasant Feeling | Δ | ◎ | Δ | Δ | Δ | Δ |
| Reduction of Tobacco Stink | ◎ | ◎ | ◎ | ◎ | ◎ | ◎ |
| Reduction of Bunt Smell | ◎ | ◎ | ○ | Δ | ◎ | — |
| Reduction of Tar Stink | ◎ | ◎ | ○ | Δ | ○ | Δ |
| Reduction of Stimuli | Δ | ◎ | ○ | — | — | — |

TABLE 8-continued

| Evaluated Item | Sample No. 1 | 2 | 3 | 4 | 5 | 6 |
|---|---|---|---|---|---|---|
| Reduction of Smokiness | — | ◎ | Δ | — | — | Δ |
| Generation of Flavor | ◎ | ◎ | ◎ | ◎ | ◎ | Δ |
| Reduction of Whole Odor | — | — | — | — | — | — |

Note:
◎ = Highly improved with 1% risk factor
○ = Improved with 5% risk factor
Δ = Slightly improved
— = Not improved The sidestream smoke of samples Nos. 1 and 2 had a fruity flavor, and is reduced in stink of a tobacco represented by burnt smell and stink of tar. Even if the lactone was dissolved in the base solution in the production of sample No. 3, the same improving effect was observed. For the sidestream smoke of sample No. 2, even properties originating from smoke particles, such as stimuli and smokiness, were improved. That is, a great improvement was made, associated with reduction in unpleasant feelings. The sidestream smoke of samples Nos. 4 and 5 had a creamy and coconut-like flavor, and reduced stink of a tobacco. The sample No. 6 had a curry spice-like flavor, masking the stink of a tobacco.

As described above, the smell of the sidestream smoke of the cigarette wrapped in the cigarette paper containing the sidestream smoke smell-improving agent of the invention was evidently improved by being masked by the lactone flavor though the extent of the improvement was varied dependent on the kind and amount of the lactone used.

EXAMPLE 10

In this Example, the effect of the sidestream smoke smell-improving agent of the invention added to a seam paste was examined. As the seam paste, a vinyl acetate copolymer-based seam paste or a carboxymethylcellulose-based seam paste was used. 1000 mg/L of γ-undecalactone was added to each of the seam pastes, and then each of the pastes was applied to a commercially available low sidestream smoke cigarette paper.

As a control, an experiment was also carried out for the case where an aqueous solution of γ-undecalactone was applied to the cigarette paper and dried.

After the applications, each of the cigarette papers was dried at 100° C. for 2 hours and then the same acceleration test as in Example 1 was carried out. Thereafter, the amount of the carried lactone in the cigarette paper was measured by the thermal decomposition method. Results obtained are shown in Table 9.

TABLE 9

| Seam Paste | Amount of Lactone Added (mg) | Carried Amount of Lactone After Acceleration Test (mg) | Generation Rate of Flavor (%) |
|---|---|---|---|
| Vinyl Acetate Copolymer-based | 0.49 | 0.39 | 80 |
| Carboxymethylcellulose-based | 0.67 | 0.08 | 12 |
| Control (Aqueous Solution Applied) | 0.33 | 0.08 | 24 |

From the results shown in Table 9, it was confirmed that γ-undecalactone was stably carried in the cigarette paper even if γ-undecalactone was added to the seam paste. Further, it was found that when γ-undecalactone was added to the seam paste, the flavor of γ-undecalactone became weak. The flavor of γ-undecalactone was hardly released from, in particular, the vinyl acetate copolymer-based seam paste.

As described above, according to the present invention, there is provided a cigarette paper having a sidestream smoke smell-improving agent that does not substantially release any odor during non-smoking but can mask an unpleasant smell of the sidestream smoke during smoking so as to improve the smell of the sidestream smoke, though having a relatively simple structure, as well as a cigarette.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cigarette paper having a sidestream smoke smell-improving agent comprising a salt of a hydroxy acid of a lactone, wherein the salt of the hydroxy acid is an alkali metal salt or an alkaline metal salt.

2. The cigarette according to claim 1, wherein the salt of the hydroxy acid is of a lactone having 5 or more ring members.

3. The cigarette according to claim 1, wherein the salt of the hydroxy acid is of a γ-lactone or a δ-lactone.

4. The cigarette according to claim 1, wherein the salt of the hydroxy acid is of a lactone selected from the group consisting of γ-butyrolactone, γ-valerolactone, γ-heptalactone, γ-hexalactone, 7-octalactone, δ-nonalactone, γ-decalactone, γ-undecalactone, sautalone, abhexone, δ-butyrolactone, valerolactone, heptalactone, hexalactone, δ-octalactone, δ-nonalactone, δ-decalactone, δ-undecalactone, ω-pentadecalactone, and mixtures thereof.

5. The cigarette according to claim 1, wherein the salt of the hydroxy acid is applied as a solution in an aqueous solvent to the cigarette paper and is dried.

6. The cigarette according to claim 1, wherein the cigarette paper is adhered with an aqueous adhesive, and the salt of the hydroxy acid is carried by the cigarette paper by being incorporated in the adhesive.

7. A cigarette wrapped by a cigarette paper, said cigarette paper having a sidestream smoke smell-improving agent comprising a salt of a hydroxy acid of a lactone, wherein the salt of the hydroxy acid is an alkali metal salt or an alkaline metal salt.

8. The cigarette paper according to claim 7, wherein the salt of the hydroxy acid is of a lactone having 5 or more ring members.

9. The cigarette paper according to claim 7, wherein the salt of the hydroxy acid is of a γ-lactone or a δ-lactone.

10. The cigarette paper according to claim 7, wherein the salt of the hydroxy acid is of a lactone selected from the group consisting of γ-butyrolactone, γ-valerolactone, γ-heptalactone, γ-hexalactone, γ-octalactone, γ-nonalactone, γ-decalactone, γ-undecalactone, sautalone, abhexone, δ-octalactone, δ-nonalactone, δ-decalactone, δ-undecalactone, ω-pentadecalactone, and mixtures thereof.

11. The cigarette paper according to claim 7, wherein the salt of the hydroxy acid is applied as a solution in an aqueous solvent to the cigarette paper and is dried.

* * * * *